US005941420A

United States Patent [19]

Connan

[11] Patent Number: 5,941,420

[45] Date of Patent: Aug. 24, 1999

[54] MULTICHAMBER CONTAINER DISPENSING ORIFICES

[75] Inventor: Patrick Andre Connan, Lebanon, N.J.

[73] Assignee: Colgate-Palmolive Company, New York, N.Y.

[21] Appl. No.: 08/907,302

[22] Filed: Aug. 6, 1997

[51] Int. Cl.[6] ..... B65D 35/22

[52] U.S. Cl. ..... 222/94; 222/145.3

[58] Field of Search ..... 222/94, 107, 145.3

[56] References Cited

U.S. PATENT DOCUMENTS

| | | | |
|---|---|---|---|
| D. 277,073 | 1/1985 | Czech . | |
| D. 306,554 | 3/1990 | Lawson . | |
| D. 307,113 | 4/1990 | Thompson . | |
| D. 311,861 | 11/1990 | Vanhoutte . | |
| D. 313,181 | 12/1990 | Pettengill . | |
| D. 315,496 | 3/1991 | Pettengill . | |
| D. 320,735 | 10/1991 | Pettengill . | |
| D. 356,026 | 3/1995 | Iaia et al. . | |
| 1,363,064 | 12/1920 | Stegath . | |
| 1,676,734 | 7/1928 | Hopkins . | |
| 1,828,865 | 10/1931 | Hopkins . | |
| 1,894,115 | 1/1933 | Murphy . | |
| 2,103,817 | 12/1937 | Johnson . | |
| 2,107,987 | 2/1938 | Johnson . | |
| 2,517,027 | 8/1950 | Rado . | |
| 2,661,871 | 12/1953 | Huenergardt . | |
| 2,905,364 | 9/1959 | Marraffino . | |
| 2,914,220 | 11/1959 | Marraffino | 222/145.3 |
| 2,939,610 | 6/1960 | Castelli . | |
| 2,944,705 | 7/1960 | Strumor . | |
| 2,959,327 | 11/1960 | Bloom . | |
| 3,105,615 | 10/1963 | Koga . | |
| 3,135,428 | 6/1964 | Gallo, Sr. | 222/145.3 |
| 3,166,221 | 1/1965 | Neilsen . | |
| 3,182,728 | 5/1965 | Zabriske . | |
| 3,197,071 | 7/1965 | Kuster . | |
| 3,227,319 | 1/1966 | Rosier . | |
| 3,380,632 | 4/1968 | Wilson . | |
| 3,506,157 | 4/1970 | Dukess . | |
| 3,788,520 | 1/1974 | Dukess . | |
| 3,881,529 | 5/1975 | Mannara . | |
| 3,948,704 | 4/1976 | Evans . | |
| 3,980,222 | 9/1976 | Hood . | |

(List continued on next page.)

FOREIGN PATENT DOCUMENTS

| | | |
|---|---|---|
| 0 503 824 | 9/1992 | European Pat. Off. . |
| 0576222 | 6/1993 | European Pat. Off. . |
| 0 693 437 | 1/1996 | European Pat. Off. . |
| 0 388 185 | 6/1996 | European Pat. Off. . |
| 2 645 513 | 10/1990 | France . |
| 3420324 | 1/1988 | Germany . |
| 93 02 869 | 5/1993 | Germany . |
| 43 35 970 | 4/1995 | Germany . |
| 29515380 | 1/1996 | Germany . |
| 2-205501 | 8/1990 | Japan . |
| 112375 | 12/1962 | Pakistan . |
| 2142611 | 1/1985 | United Kingdom . |
| WO 94/07771 | 4/1994 | WIPO . |
| WO 94/14680 | 7/1994 | WIPO . |
| WO 97/11896 | 4/1997 | WIPO . |

*Primary Examiner*—Kenneth Bomberg
*Attorney, Agent, or Firm*—Michael McGreal

[57] ABSTRACT

A multichamber container such as a multichamber tube or multichamber pump can deliver the contained products in varying arrays by the use of container shoulders of different channel configurations. The container body remains the same with chamber dividing walls extending from the container base to the container shoulder. The container shoulder attachment to the container walls and to the chamber dividing walls can remain essentially the same. Within the shoulder, channels direct the flow of each product so that it has a number of arrays from an A/B/A sandwich to axial arrays to semiconcentric arrays to fully concentric arrays. The channels that are a part of the shoulder will direct the product from each chamber to be dispensed in a single stream or multiple streams. Also, the streams can be shaped to many different shapes by the shape and the arrangement of the channels in the shoulder.

16 Claims, 10 Drawing Sheets

U.S. PATENT DOCUMENTS

| | | | |
|---|---|---|---|
| 4,014,463 | 3/1977 | Hermann . | |
| 4,040,420 | 8/1977 | Speer . | |
| 4,046,288 | 9/1977 | Bergman . | |
| 4,089,437 | 5/1978 | Chutter . | |
| 4,099,651 | 7/1978 | Von Winckelmann . | |
| 4,148,417 | 4/1979 | Simmons . | |
| 4,211,341 | 7/1980 | Weyn . | |
| 4,260,077 | 4/1981 | Schroeder . | |
| 4,487,757 | 12/1984 | Kiozpeoplou . | |
| 4,528,180 | 7/1985 | Schaeffer . | |
| 4,687,663 | 8/1987 | Schaeffer . | |
| 4,742,940 | 5/1988 | Wilkinson . | |
| 4,747,517 | 5/1988 | Hart . | |
| 4,773,562 | 9/1988 | Gueret . | |
| 4,819,789 | 4/1989 | Linner . | |
| 4,964,539 | 10/1990 | Mueller . | |
| 4,969,767 | 11/1990 | Madden | 222/145.3 |
| 4,974,756 | 12/1990 | Pearson . | |
| 4,981,241 | 1/1991 | Keller . | |
| 5,020,694 | 6/1991 | Pettengill . | |
| 5,038,963 | 8/1991 | Pettengill . | |
| 5,045,305 | 9/1991 | Clarkson . | |
| 5,076,464 | 12/1991 | Simon . | |
| 5,078,963 | 1/1992 | Mallen . | |
| 5,092,496 | 3/1992 | Gayle et al. . | |
| 5,102,013 | 4/1992 | Schneider et al. | 222/145.3 |
| 5,102,016 | 4/1992 | Ball et al. | 222/145.3 |
| 5,137,178 | 8/1992 | Stokes . | |
| 5,145,668 | 9/1992 | Chow . | |
| 5,209,376 | 5/1993 | Dirksing . | |
| 5,224,627 | 7/1993 | Weag . | |
| 5,244,120 | 9/1993 | O'Meara . | |
| 5,269,441 | 12/1993 | O'Meara . | |
| 5,289,949 | 3/1994 | Gentile . | |
| 5,295,615 | 3/1994 | Gentile . | |
| 5,318,203 | 6/1994 | Iaia et al. . | |
| 5,332,124 | 7/1994 | Cancro . | |
| 5,335,827 | 8/1994 | Gentile . | |
| 5,476,647 | 12/1995 | Chow . | |
| 5,547,107 | 8/1996 | Boiardi . | |
| 5,615,803 | 4/1997 | Hatakeyama et al. | 222/145.3 |
| 5,702,033 | 12/1997 | Beaver | 222/145.3 |

MULTICHAMBER CONTAINER DISPENSING ORIFICES

FIELD OF THE INVENTION

This invention relates to the multichamber containers that can deliver the container contents in different arrays. More particularly, this invention relates to multichamber tubular containers that can deliver different products in different arrays.

BACKGROUND OF THE INVENTION

Multichamber containers are needed to simultaneously dispense products. Although the products in the chambers of these containers can be the same, they usually will be different. They will differ in at least one of composition, color and rheology. In most instances the product will be different in composition. Multichamber containers primarily are used to dispense two or more incompatible substances. Such substances must be kept separate until the time of use. Although various dispensing containers have been used to simultaneously dispense two different components of a product, such as an adhesive, it is only now that it also is desired to dispense the substances in an aesthetically pleasing manner. This is particularly the case in the dispensing of cosmetics, dentifrices and related personal care products. Also, in order to convey to the user that more than one product is being dispensed it is desirable to have the products be of two or more different colors. In this way the user can visually see that more than one product is being dispensed. This also is valuable in order for the user to see that the desired amount of each product is being simultaneously dispensed. When equal amounts are to be dispensed, if the amounts of each color are visually about equal, the user is assured that equal amounts are being dispensed. If the amounts of each color are not equal, more of one product can be added to equalize the amounts from by the manipulation of the dispensing container.

Dual chamber tubes as one type of multichamber container have been known for many years. These tubes can be of two general types. These are the "tube-in-a-tube" type and the "side-by-side" chamber type. U.S. Pat. Nos. 1,699,532; 2,939,610 and 4,211,341 disclose the "tube-in-a-tube" type of dual chamber dispenser. In this type of container, one tube is concentrically disposed within the other tube. The "side-by-side" tube containers are shown in U.S. Pat. Nos. 1,894,115; 3,227,319; 3,506,157; 3,788,520 and 4,089,437. In each of these patents the chambers are located longitudinally adjacent to each other with the tubular container sidewall forming a wall of each chamber. These two different general types of tube containers will deliver two separate streams of product. However, the "side-by-side" arrangement has been found to be most effective to deliver substantially equivalent amounts of product from each chamber.

Various striping inserts have been used with tube containers in order to place a small amount of one product onto surface another product. The objective usually is to place a color stripe on the exterior surface of a larger mass of a noncolored product. These inserts guide and place a small amount of a product on a larger amount of a product. Striping inserts are illustrated by U.S. Pat. Nos. 2,935,231; 2,959,327; 3,135,428; 4,842,164; 4,969,767 and 5,102,013. These inserts are used primarily with single chamber tube containers where one product is located above the other in the tube. The net result of the use of such an insert is that the delivered product can be composed of two or more different colors.

Another type of a multichamber container is the pump. Such pumps contain two or more separate chambers. When a force is applied to the pump actuating surface, each of the contained substances is dispensed. Multichamber pump containers are illustrated by U.S. Pat. Nos. 3,166,221; 5,289,949; 5,332,124; and 5,335,827.

In each of these patents disclosing dual chamber containers, there is a direct relationship between the tube nozzle channels and the chambers in the tube. For tubes, each of the chambers terminate in a D-shaped channel in the nozzle for products in a side-by-side orientation in the container or in a concentric arrangement for products in a concentric tube-in-a-tube orientation. For pumps the products also usually will be dispensed in side-by-side D-shaped strands. That is, the products are dispensed in the same form as they are when located within the tube. When the products are of different colors, they are delivered in side-by-side D-shaped strands or concentrically. There is no disclosure in any of these references of how to in deliver the product in each chamber in other than this side-by-side D-shaped strand arrangement or concentrically.

The present invention solves the problem of delivering products from a container where the products are in a "side-by-side" orientation, such as in a tube or a pump, in other than side-by-side D-shaped strands. In the present container nozzle configurations, the products can be delivered in various arrays from alternating segments to partially or fully concentric arrays. The alternating segments can be linear, triangular or other shapes. By designing the channels in the container nozzle to direct the flow of each product, the strands of each product also can be in a large number of different arrays. The container body remains the same and the attachment of the chamber divider walls to the container shoulder nozzle remains essentially the same. The arrangement, i.e. plumbing, of the channels that will deliver the products to the exit of the container will cause the products to be delivered in the different arrays.

BRIEF SUMMARY OF THE INVENTION

The present invention is directed to multichamber containers where the chambers are in a longitudinal relationship. These can be tube or pump containers. When a tube container, there are inner divider walls with the outer tube wall forming a wall of each of the chambers. Such tube containers when having two chambers usually will deliver the products in D-shaped segments. When there are three or more chambers, the products usually will be delivered in triangular pie-shaped segments. The products usually will be delivered in essentially the same shape as they exist in the tube. In the present containers the products can be delivered in a wide range of shapes and arrays. This is accomplished by having channels in the shoulder of the tube container that will direct the flows of the products to form particular shapes and arrays.

In pump containers the products usually will be in two or more tubular containers. Each container delivers a product to the nozzle where for two products each will be delivered in a D-shaped strand. These can be delivered in a range of shapes and arrays.

When there is a product "A" and a product "B", the channels in the shoulder can be arranged to deliver an array such as A/B/A; A/B/A/B or concentrically with product "A" partially or fully surrounding product "B". When a tube container has a longitudinal wall which extends from the bottom end to the shoulder and is bonded or otherwise attached to the shoulder. The lower end of the shoulder is linear in shape or may be shaped to accommodate a number of directing channels. In order to provide an A/B/A array, product "A" enters two different channels while product "B" enters a single channel. In order to achieve an A/B/A/B array, both product "A" and product "B" will enter two different channels. And, in order to achieve a concentric array, product "B" is directed up a central channel while product "A" is directed up a concentric channel and spreads out surrounding product "B". This A/B/A and A/B/A/B arrays can be delivered in a sandwich-shaped array, triangular-shaped array or an array of another shape.

Many different arrays of products can be produced using these tube containers. The preferred container is a dual chamber tube container or pump container. The preferred arrays of products are an A/B/A array or a concentric array. The only limiting factors as to the array that is delivered, and the shape of the array, is the ability to mold the shoulder or nozzle to deliver the particular array.

DETAILED DESCRIPTION OF THE DRAWINGS

The present multichamber dispensing containers will be described in more detail with reference to the Figures. The Figures show a dual chamber dispenser which is the preferred mode of the invention. However, the disclosed concepts are applicable to dispensing containers that have more than two chambers. Also, the dispensing container need not be a tube container. It can readily by a pump container of essentially any structure. However, a tube dispenser is the preferred mode for the use of the invention at this time.

Figure 1:
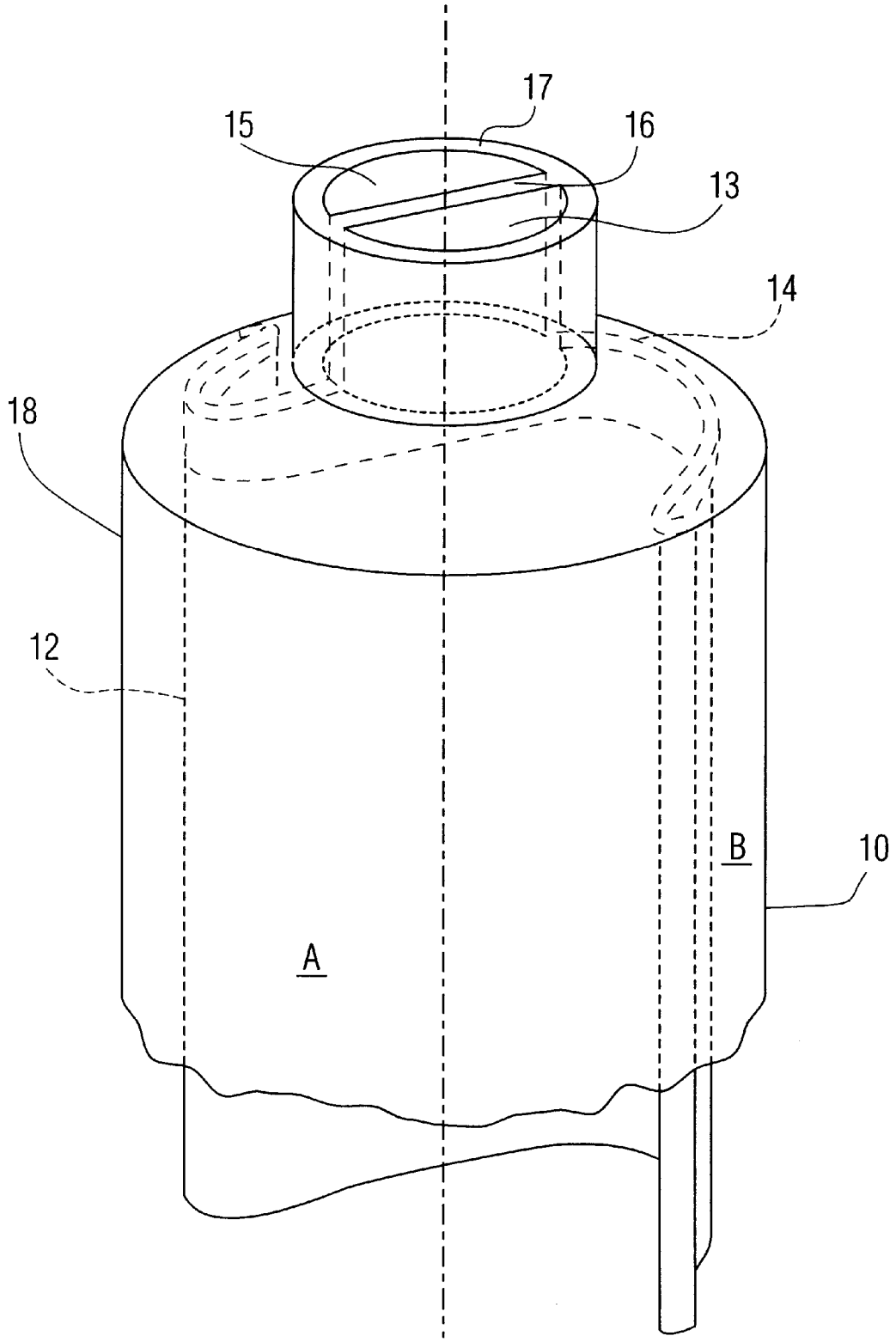
FIG. 1 shows a conventional dual tube container with each component in a side-by-side relationship.

In FIG. 1 there is shown dispensing container 10 which has a container divider wall 12 and a shoulder section 14. The container divider wall preferably is a thin plastic sheet of high flexibility. The container has an outer wall 18. The shoulder section has dispensing openings 13 and 15 that are formed by peripheral wall 17 and nozzle divider wall 16. The container divider wall 12 is attached to the shoulder divider wall 17.

Figure 1A:
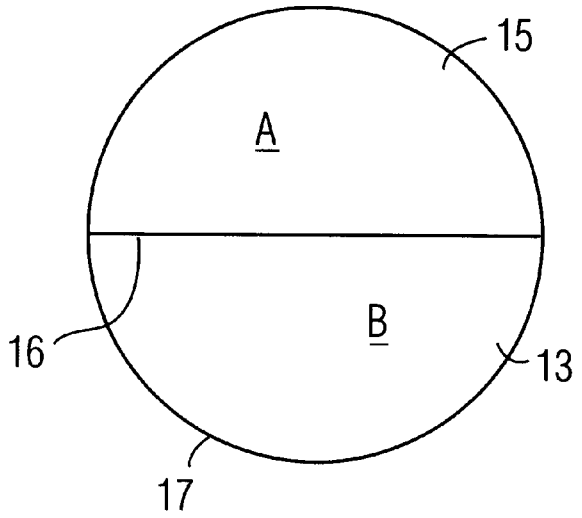
FIG. 1A is a schematic of the dispensing arrangement of the tube container of FIG. 1 in an A/B relationship.
Figure 1B:
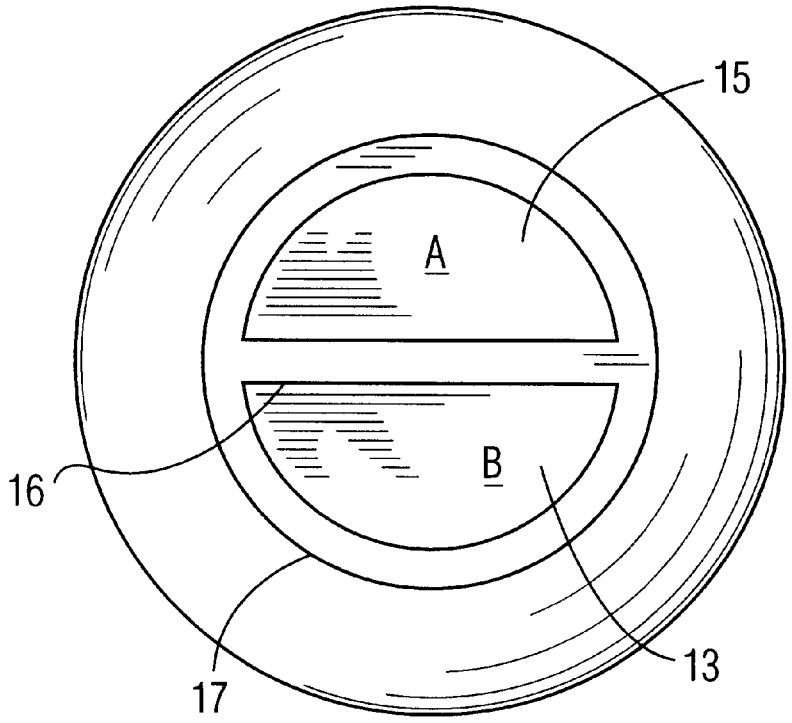
FIG. 1B is a top plan view of the container of FIG. 1.

FIG. 1A shows the dispensing arrangement from the dispensing container. A product "A" is dispensed at 15 and a product "B" is dispensed at 13. They are maintained separate by shoulder divider wall 16 and maintained in this overall shape by peripheral wall 17. These products are each dispensed in a D-shaped strand which generally is the shape as located in the container. This is more clearly shown in FIG. 1B which is a top plan view of the container. The D-shape of each strand is clearly shown.

Figure 2:
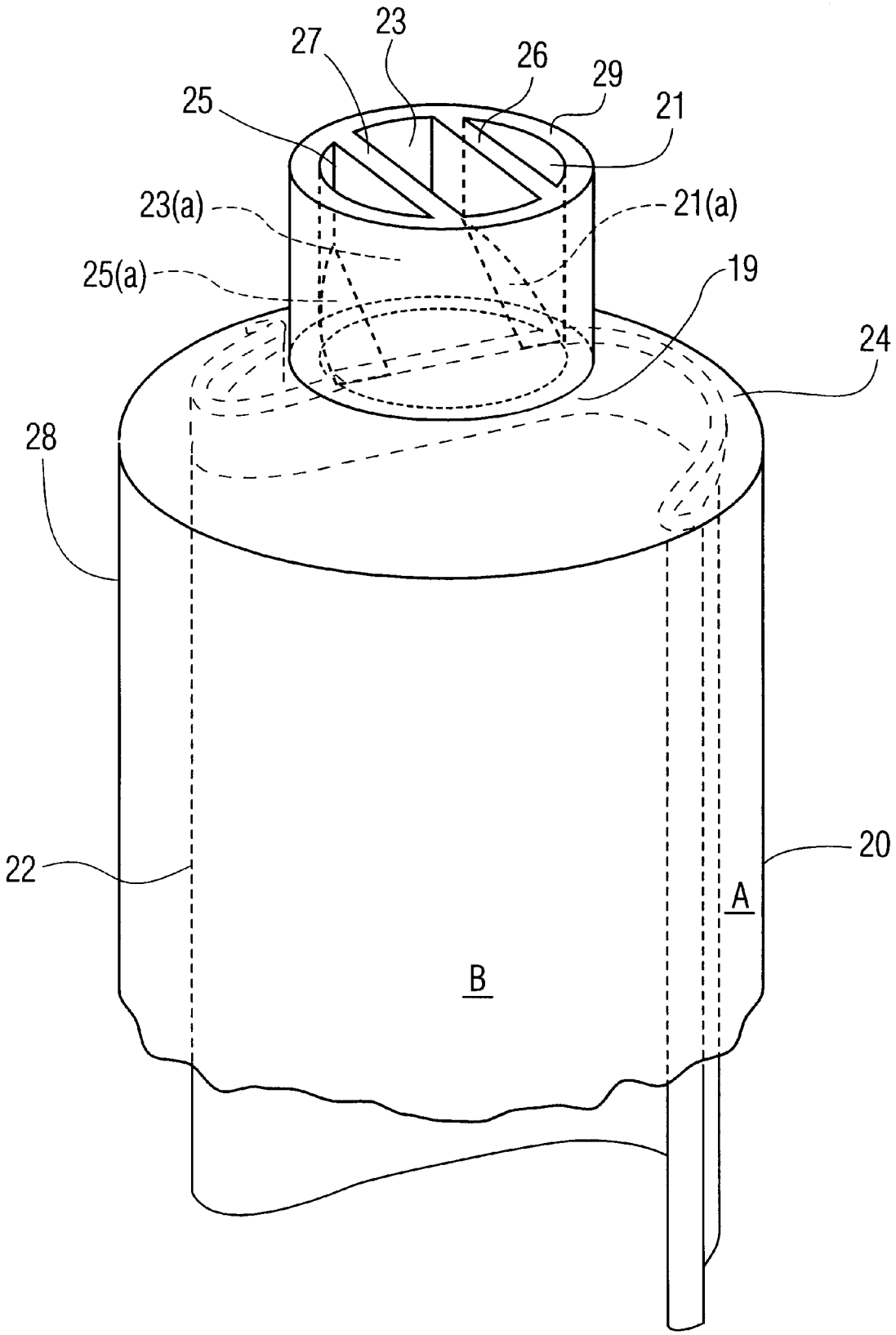
FIG. 2 shows a dual chamber container with a dispensing shoulder to provide three streams of dispensed product.
Figure 2A:
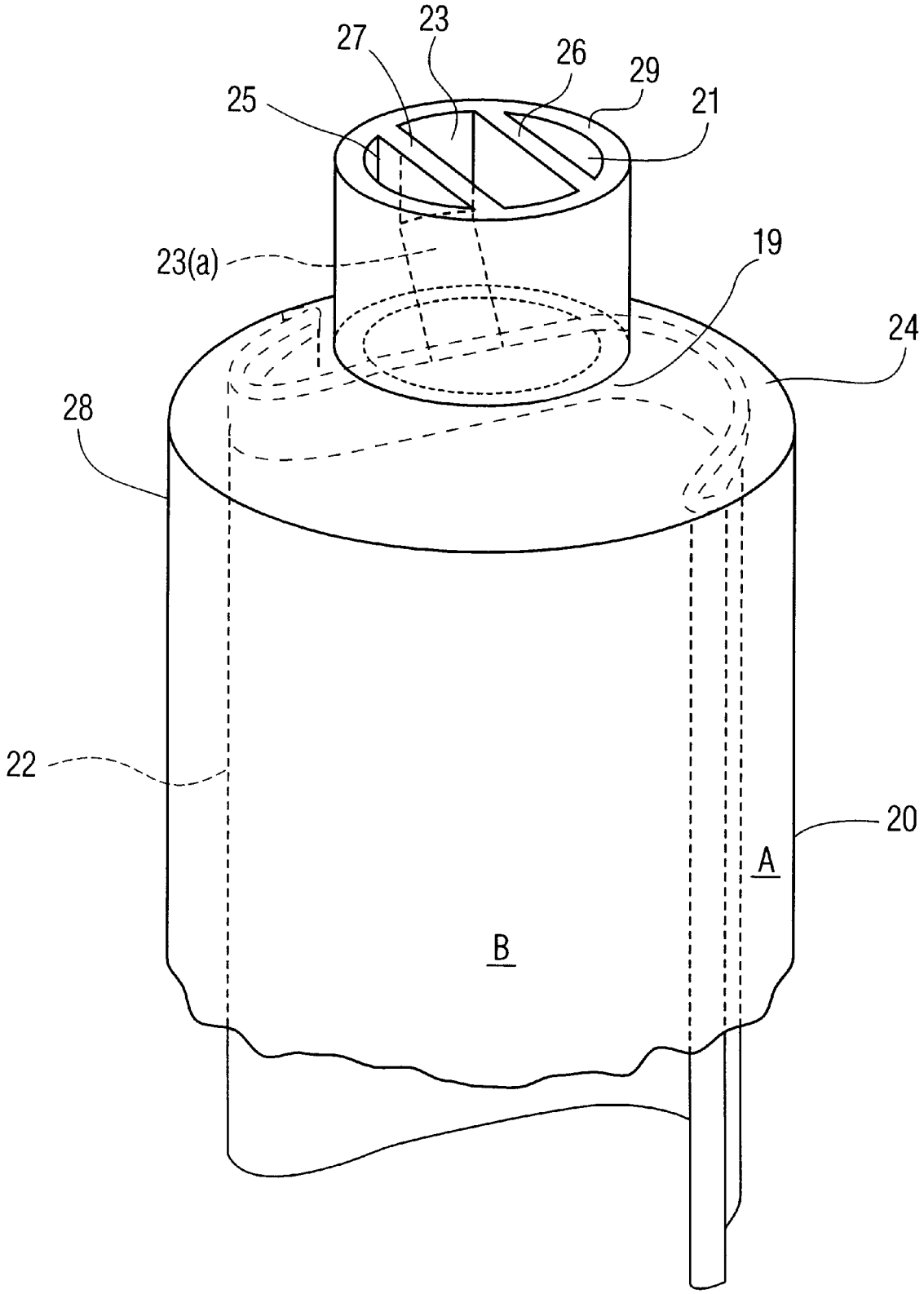
FIG. 2A shows the structure of the center channel of FIG. 2 in more detail.
Figure 2B:
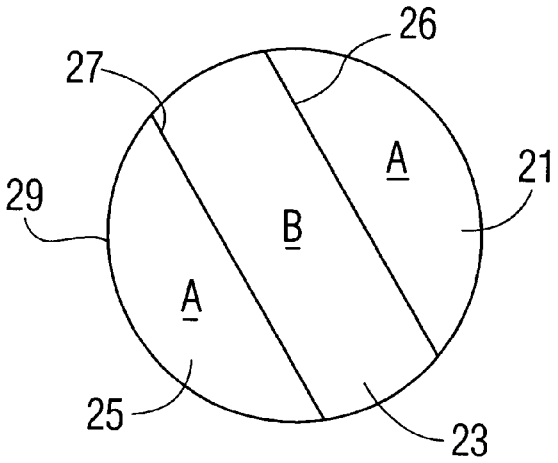
FIG. 2B is a schematic of the dispensing arrangement in an A/B/A relationship.
Figure 2C:
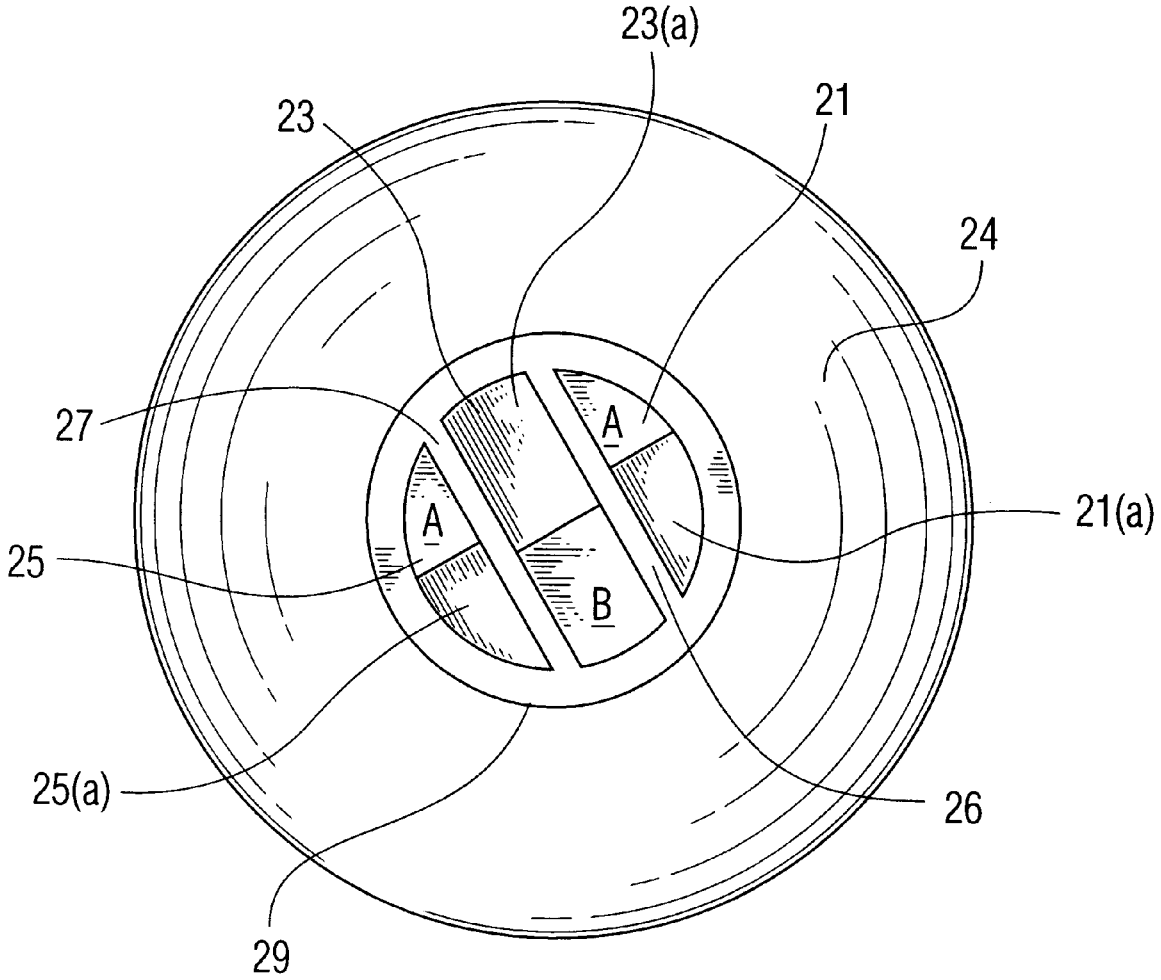
FIG. 2C is a top plan view of the dual chamber container of FIG. 2.

FIG. 2 shows a dual chamber dispenser where the dispensed product is dispensed in a A/B/A array. Dispensing container 20 has container divider wall 22 and shoulder 24. Outer wall 28 encloses the container. The dispensing exit has dispensing outlets 21, 23 and 25. These are formed by peripheral wall 29(*a*) and nozzle divider walls 26 and 27 of nozzle 29, and sloping walls 21(*a*), 23(*a*) and 25(*a*). The dotted lines show the structure of the nozzle walls as the nozzle walls connected to the shoulder wall 19. This is further illustrated in FIG. 2A where the structure of the nozzle walls is shown less the structure of the inner surface of nozzle peripheral wall 29. The container divider wall 22 is attached to lower edge of the shoulder wall 19. As is seen in FIG. 2B, the product "A" in the container exits at openings 21 and 25 with the "B" product exits at opening 23 to produce an A/B/A array. This dispensing shoulder is shown in more detail in FIG. 2C. The product "B" dispensing is maintained in position by shoulder divider walls 26 and 27 and a lower sloping wall 23(*a*). One "A" product is directed by shoulder divider wall 26, peripheral wall 29(*a*) of nozzle 29 and sloping wall 21(*a*). The other "A" product stream is directed by shoulder divider wall 27, peripheral wall 29 and sloping wall 25(*a*). The net result is the A/B/A array with product "A" and product "B" being of different composition, color and/or rheology.

Figure 3:
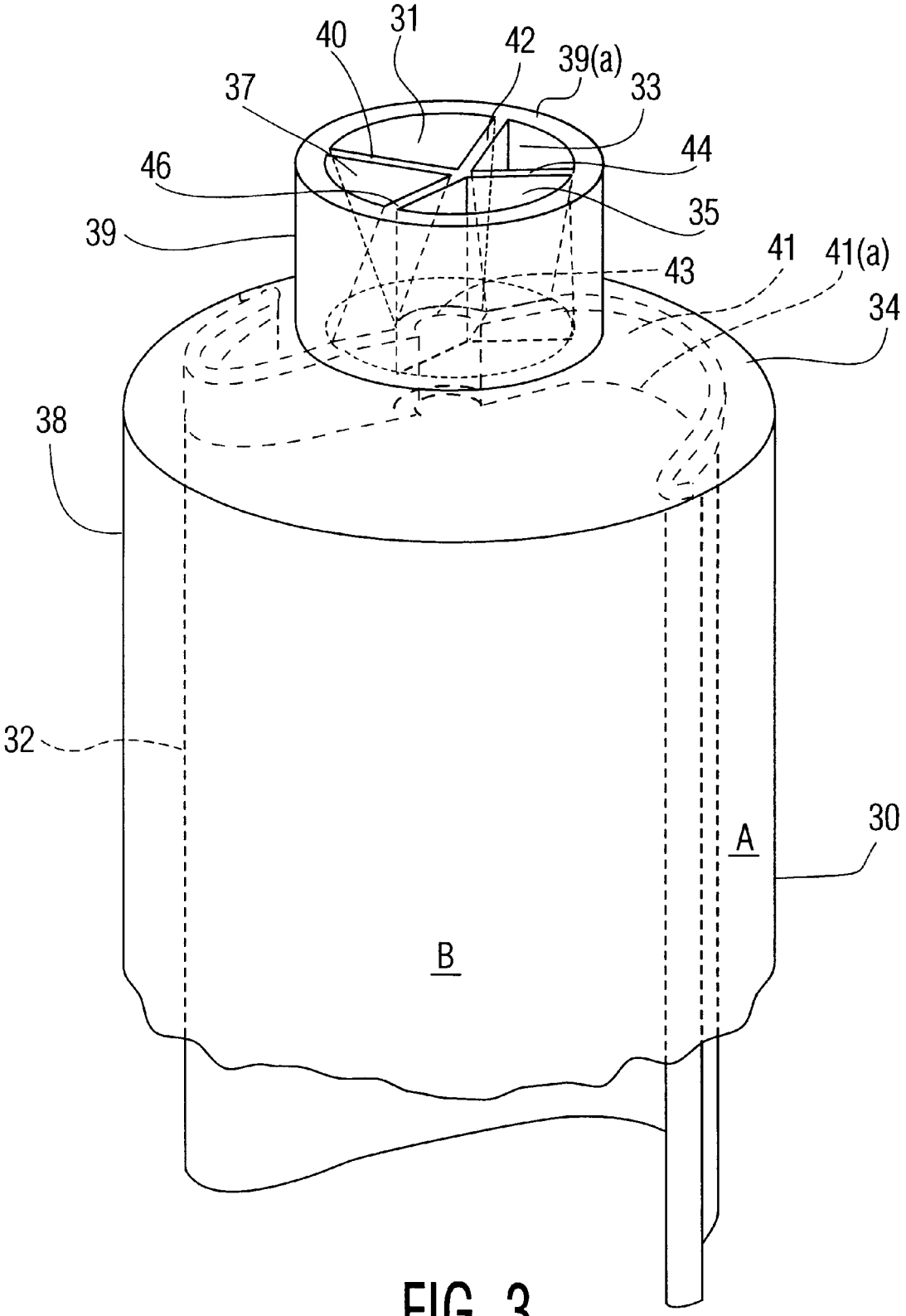
FIG. 3 shows a dual chamber container with a dispensing shoulder to produce four streams of dispensed product.

In FIG. 3 there is shown a product array of A/B/A/B from two different chambers. Dispensing container 30 has container divider wall 32 and shoulder 34. Outer wall 38 encloses the container. The exit opening of nozzle 39 is formed by peripheral wall 39(*b*) and nozzle divider walls 40, 42, 44 and 46. These walls in conjunction with sloping walls 31(*a*), 33 (*a*) and 37(*a*) form dispensing openings 31, 33, 35 and 37 respectively. The container divider wall 32 is attached to shoulder edge 41(*a*) which has an arched center portion 43 to form the dispensing opening 31. In FIG. 3A the dispensing array of product "A" and product "B" is shown in more detail. As in the embodiment of FIG. 2 and other figures, product "A" and product "B" usually will be of different composition, color and/or rheology.

Figure 3B:
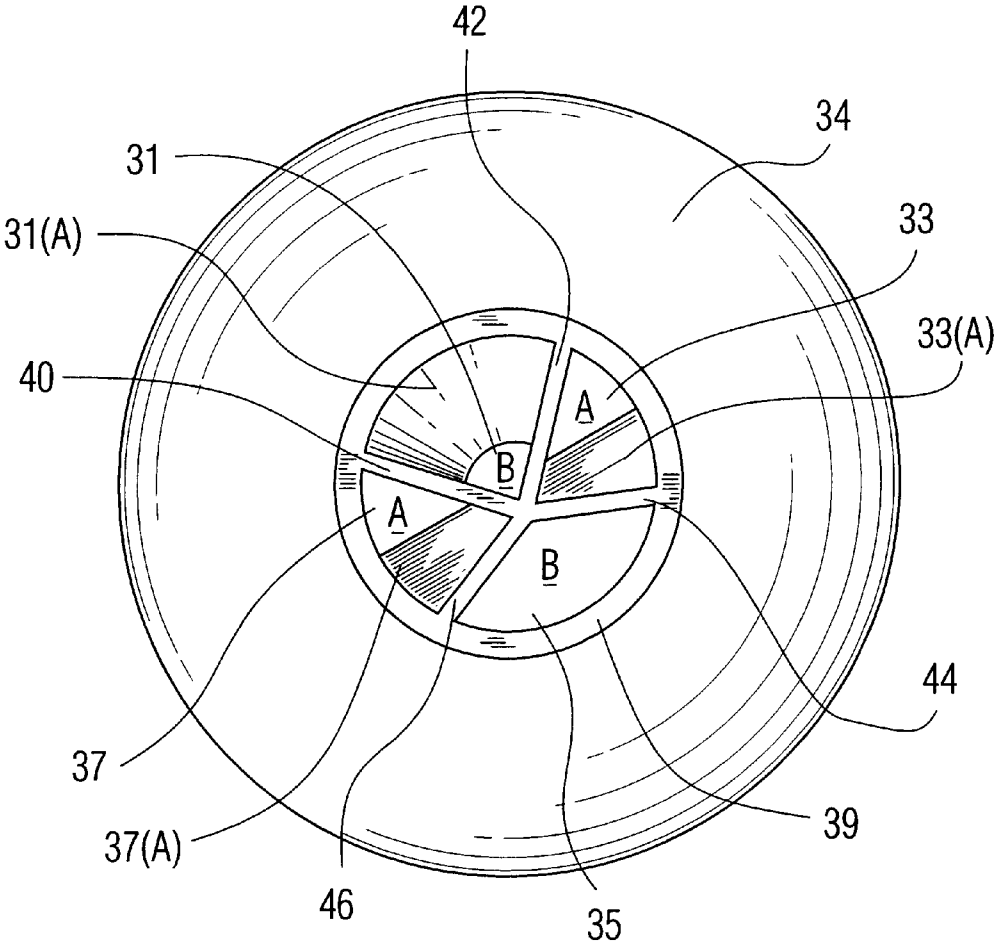
FIG. 3B is a top plan view of the dual chamber container of FIG. 3.
Figure 3A:
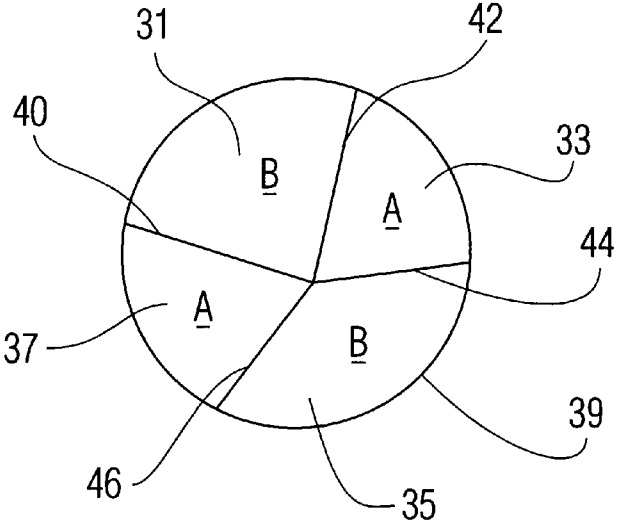
FIG. 3A is a schematic of the dispensing arrangement in an A/B/A/B relationship.
Figure 3C:
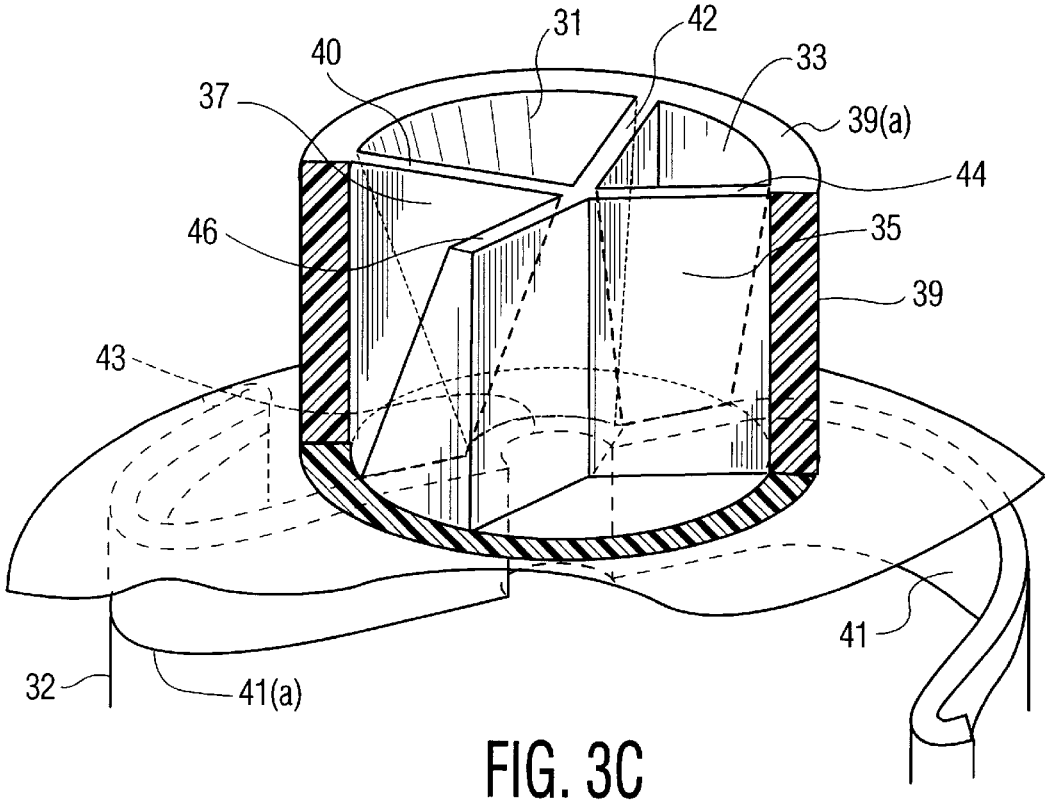
FIG. 3C is a view of the dual chamber container of FIG. 3 partially in section to show the structure of the shoulder.

In FIG. 3B the dispensing shoulder is shown in more detail. Each of the dispensing openings 31, 33, 35 and 37 is shown in detail. Each of these dispensing openings has a sloping wall to direct the flow of product "A" or product "B". Dispensing opening 31 has sloping wall 31(*a*), dispensing opening 33 has sloping wall 33(*a*) and dispensing opening 37 has sloping wall 37(*a*). These dispensing openings will dispense the two products in the four segment array that has a generally triangular shape to each of the segments. FIG. 3C is a cutaway view of the nozzle and shows the nozzle in yet more detail.

Figure 4C:
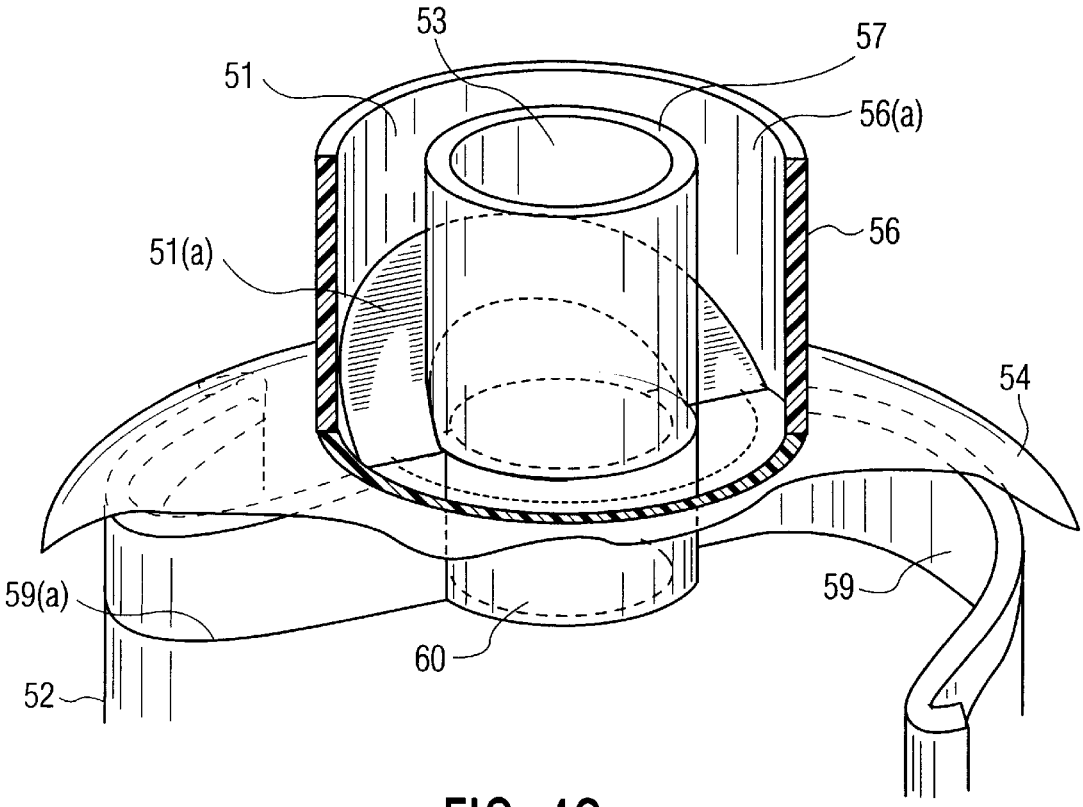
FIG. 4C is a view of the dual chamber container of FIG. 4 partially in section to show the structure of the shoulder.
Figure 4:
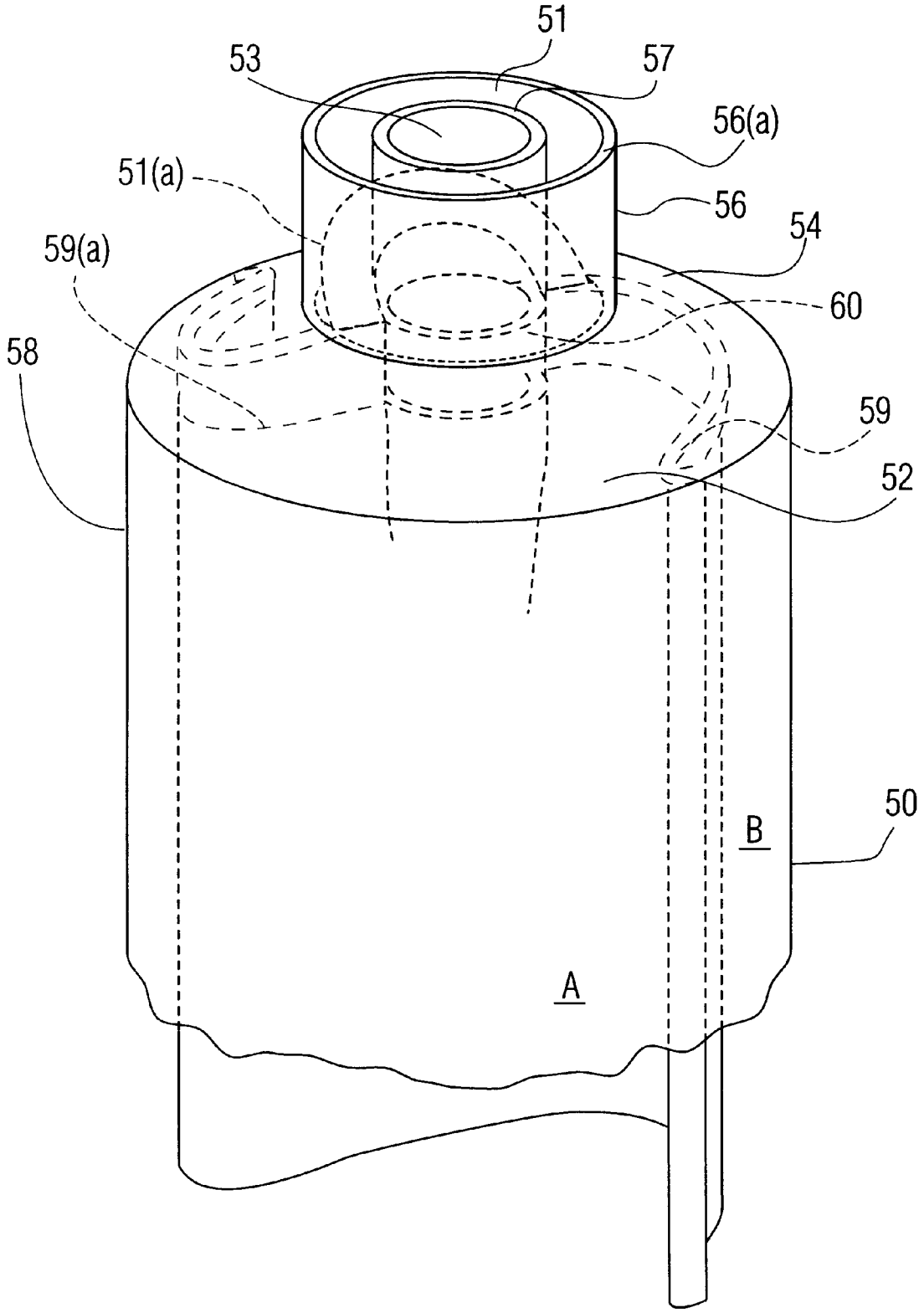
FIG. 4 shows a dual chamber container with a dispensing shoulder to produce concentric A/B streams of dispensed product.
Figure 4B:
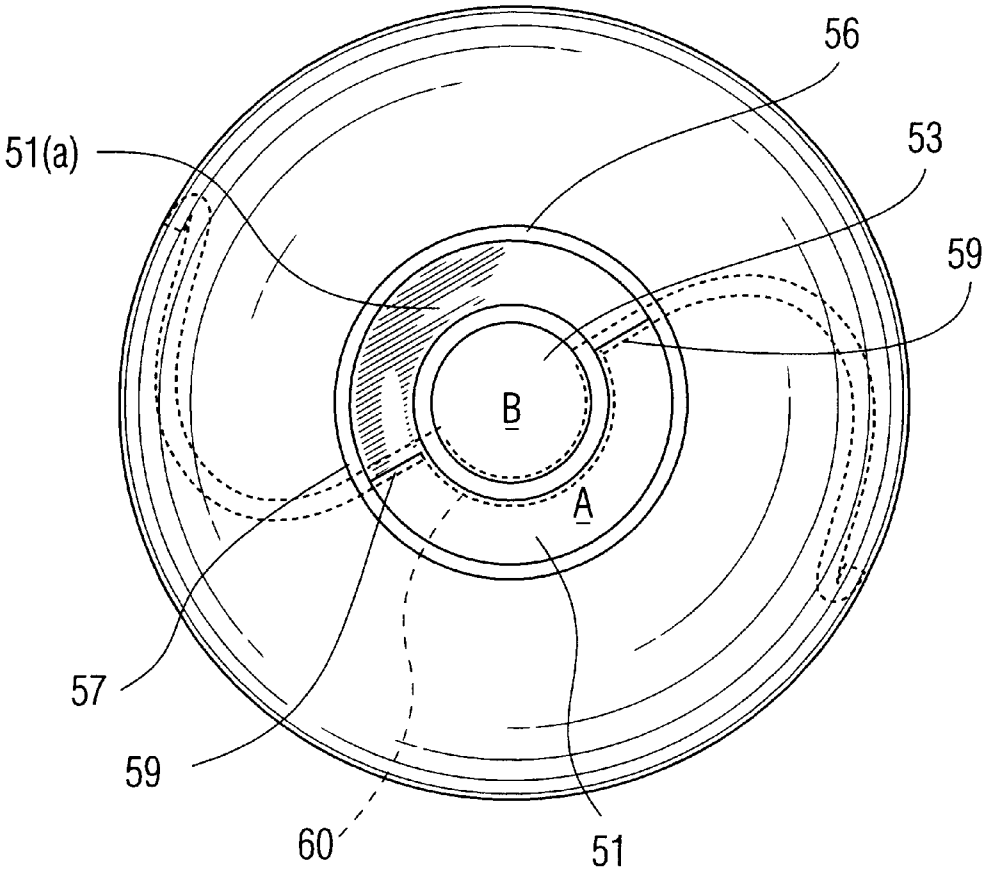
FIG. 4B is a top plan view of the dual chamber container of FIG. 4.
Figure 4A:
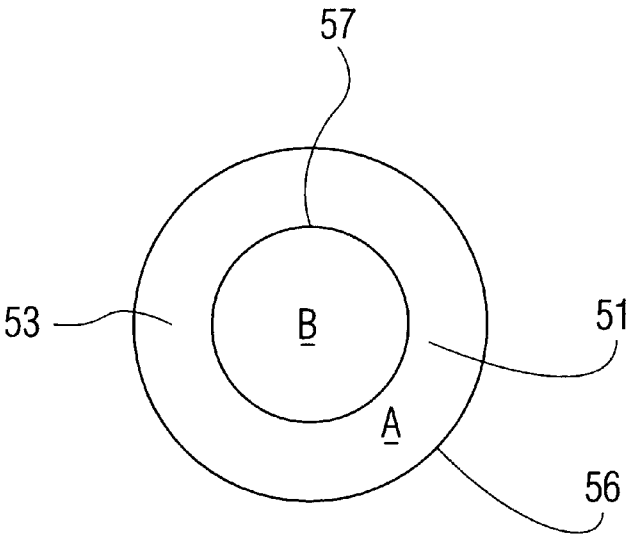
FIG. 4A is a schematic of the dispensing arrangement in a concentric A/B arrangement.

FIG. 4 shows a dual chamber dispensing container where product "A" and product "B" are dispensed in a concentric array. Dispensing container 50 has a container divider wall 52, shoulder 54 and an outer wall 58. The shoulder terminates in nozzle 56 which has peripheral wall 56(*a*). Located within peripheral wall 56(*a*) is inner circumferential wall 57. These walls form dispensing openings 51 and 53. The shoulder wall 59 has a lower edge 59(*a*) which is attached to container divider wall 52. The center part of this edge 59(*a*) is arched at 60 and follows part of the lower edge of inner circumferential wall 59(*a*). The concentric array in which product "A" and product "B" is dispensed is shown in more detail in FIG. 4A. FIG. 4B is a top plan view of the dispensing container. Sloping wall 51(*a*) of dispensing opening 51 is shown. The sloping wall 51(*a*) directs product "A" into a concentric arrangement with product "B". FIG. 4(*c*) is a cutaway view of the nozzle and shows the nozzle in yet more detail.

The containers and the dispensing shoulders can be produced using a wide range of materials. However, thermoplastics are preferred. Thermoplastics are easier to mold and to attach to other parts. Suitable thermoplastics are polyethylene and polypropylene and their respective copolymers; vinyl copolymers such as vinyl alcohol and vinyl acetate and their copolymers; and polyesters such as polyethylene terephthalate. The requirement for a plastic is that it be moldable and that the parts such as the container divider wall and the shoulder be attachable.

The products that can be dispensed from these containers are limitless. Although the same product can be in each chamber, It is preferred that they differ in some chemical or physical characteristic. That is, preferably they will differ in one of composition, color and/or rheology. A useful difference is one of color. When the difference is color it will be easier for the user to determine if the products are being dispensed In the correct ratio. Also, when the difference is color the ornamental presentation of the products is enhanced. The preferred products to be used in conjunction with the present containers are dentifrices. This is the case since some of the active components in dentifrices are not compatible. Different parts of the dentifrice formulations must be kept separate until use. This is accomplished by the use of multichamber tube and pump dispensers. The present invention aids in the delivery of these new dentifrice formulations.

The figures show the preferred modes of carrying-out the invention. However, the products can be delivered in a much greater number of arrays. All such arrays are within the present concept. Also, the invention has been described with regard to a tube container. However, it can be applied to pump container and essentially any other container where two or more products are stored in a longitudinal side-by-side relationship. Products in this relationship need not be dispensed in two D-shaped strands. Rather they can be dispensed in three or more streams, or can be dispensed in a concentric array. The only limit is the ability to mold the shoulder portion, and with regard to a tube, the ability to attach the divider wall to the shoulder. The container can be a pump dispenser since the forming of the array Is in the nozzle portion of the pump. There merely is the substitute of the present nozzle on the pump dispensers with one of the nozzle embodiments of the present invention.

What is claimed is:

1. A container for delivering an array of color products from a source of at least two products comprising a container body having an outer wall and a container shoulder attached to one end of said container body, said container body having at least two separate chambers separated by a dividing wall, peripheral walls of each of said at least two separate chambers being comprised of at least a portion of said container body outer wall and at least a portion of said dividing wall, said dividing wall attached at a first end to a base of said container and at a second end to said container shoulder, said container shoulder having at least one channel for a first product and at least two channels for a second product, said first product containable in a first of said at least two separate chambers and said second product containable in a second of said at least two separate chambers.

2. A container as in claim 1 wherein said at least one channel comprises two channels for said first product and said at least two channels comprises two channels for said second product.

3. A container as in claim 1 wherein said at least one channel comprises an inner channel for said first product and said at least two channels comprises at least two outer channels for said second product, said at least two outer channels at least partially surrounding said channel for said first product.

4. A container as in claim 1 wherein said at least one channel for said first product is different in cross-sectional area than one of said at least two channels for said second product.

5. A container as in claim 1 wherein said channels are in a substantially triangular array, one side of each triangle of said triangular array being an edge of said container shoulder.

6. A container as in claim 5 wherein said at least one channel for said first product is greater in cross-sectional area than said at least two channels for said second product.

7. A container as in claim 1, further including said first and second product, wherein said first product and said second product differ in at least one of composition, color and rheology.

8. A container as in claim 1, further including said first and second product, wherein said first product and said second product are the same.

9. A container as in claim 1, further including said first and second product, wherein said first product and said second product are dentifrices.

10. A container as in claim 9 wherein said container is a tube.

11. A container for delivering an array of products from a source of products of at least two products comprising a container body and a container shoulder attached to one end of said container body, said container body having at least two separate chambers separated by a dividing wall attached at a first end to a base of said container and at a second end to said container shoulder, peripheral walls of each of said at least two separate chambers being comprised of at least a portion of said container body outer wall and at least a portion of said dividing wall, said container shoulder having at least one channel for a first product and at least one channel for a second product which at least one channel for a second product at least partially surrounds said at least one channel for said first product, said first product containable in a first of said at least two separate chambers and said second product containable in a second of said at least two separate chambers.

12. A container as in claim 11 wherein said at least one channel for said second product surrounds said at least one channel for said first product.

13. A container as in claim 11, further including said first and second product, wherein said first product and said second product differ in at least one of composition, color and rheology.

14. A container as in claim 11, further including said first and second product, wherein said first product and said second product are the same.

15. A container as in claim 11, further including said first and second product, wherein said first product and said second product are dentifrices.

16. A container as in claim 15 wherein said container is a tube.

* * * * *